US005170532A

United States Patent [19]

Holmin et al.

[11] Patent Number: 5,170,532

[45] Date of Patent: Dec. 15, 1992

[54] VIBRATION INSULATED POWER TOOL HANDLE

[75] Inventors: Mats C. Holmin, Stockholm; Sten H. Olsson, Enskede; Lars T. Skogsberg, Stenhamra, all of Sweden

[73] Assignee: Atlas-Copco Tools AB, Stockholm, Sweden

[21] Appl. No.: 801,744

[22] Filed: Dec. 3, 1991

[30] Foreign Application Priority Data

Dec. 11, 1990 [SE] Sweden ..... 9003947

[51] Int. Cl.[5] ..... E05B 3/00; E21B 11/00

[52] U.S. Cl. ..... 16/111 R; 51/170 R; 51/170 T; 81/177.1; 81/489

[58] Field of Search ..... 173/162 R, 162.1, 162.2; 81/177.1, 489; 16/46, 111; 51/170 R, 170 PT, 170 T, 170 TL, 170 EB, 170 MT; 30/381, 383

[56] References Cited

U.S. PATENT DOCUMENTS

| | | | |
|---|---|---|---|
| 4,368,556 | 1/1983 | Wanner et al. | 173/162.2 |
| 4,402,383 | 9/1983 | Bailey | 173/162.1 |
| 4,571,215 | 2/1986 | Hansen | 173/162.1 |
| 4,972,733 | 11/1990 | Olmr et al. | 81/177.1 |
| 5,038,480 | 8/1991 | Naslund | 173/162.2 |

*Primary Examiner*—W. Donald Bray

*Attorney, Agent, or Firm*—Frishauf, Holtz, Goodman & Woodward

[57] ABSTRACT

A vibration insulated power tool handle, comprising a tubular grip portion (10), a mounting means (11) for rigid mounting on a tool housing, and an elastic vibration insulating leaf spring membrane (12) interconnecting the grip portion (10) and the mounting means (11). The spring membrane (12) is formed with a central opening (19) for receiving a screw (21) of the mounting means (11) and is connected by its periphery to a socket portion (16) on the grip portion (10).

16 Claims, 1 Drawing Sheet

VIBRATION INSULATED POWER TOOL HANDLE

BACKGROUND OF THE INVENTION

This invention relates to a vibration insulated power tool handle of the type having a grip portion, a mounting means for rigid mounting on the tool housing, and an elastic vibration insulating member interconnecting the grip portion and the mounting means.

The basic problem to be solved by the invention is how to effectively protect the operator from the hazardous vibrations developed in power tools like grinding machines. Previous attempts to solve this problem have been made, and most of them have comprised handles with some kind of vibration insulating elastic elements.

Most of these known handles have provided grip means which have offered an acceptable vibration insulation. They have all failed, however, to combine a good vibration insulation with a safe and comfortable handling of the tool and a compact design.

The object of the invention is to create a power tool handle which not only provides a good vibration insulation but a safe and comfortable handling of the tool and a design that does not add to the length of the handle.

A preferred embodiment of the invention is described below in detail with reference to the accompanying drawing.

DETAILED DESCRIPTION

Figure 1:
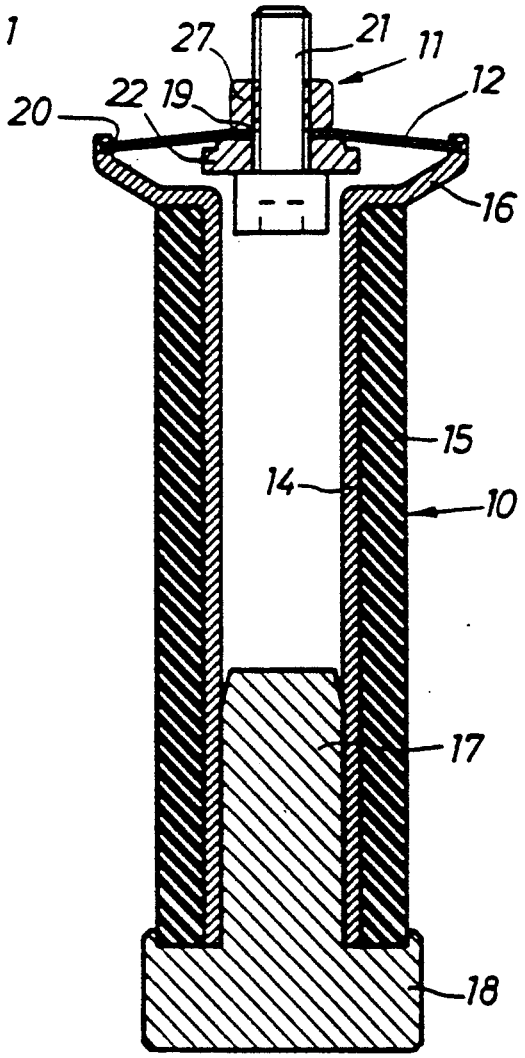
FIG. 1 shows a longitudinal section through a handle according to the invention.
Figure 2:
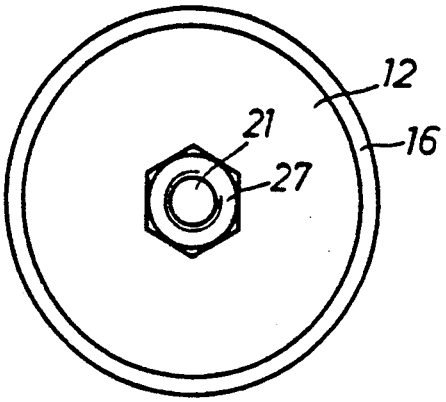
FIG. 2 shows an end view of the handle in FIG 1.

The handle shown in the drawing figures is suitable for use on for instance a rotation grinding machine, pneumatic or electric, and comprises a grip portion 10, a mounting means 11 and a vibration insulating spring element 12.

The grip portion 10 comprises a rigid inner tube 14 and a resilient outer grip sleeve 15 of for instance rubber. At its one end, the inner tube 14 has a bell shaped socket 16, and at its opposite end it receives the stem portion 17 of an inertia element 18. The purpose of the latter is to lower the resonance frequency of the handle.

The vibration insulating spring element 12 comprises a somewhat conical steel disc or membrane which is snapped by its periphery into a circumferential groove 20 in the bell shaped socket 16. The steel membrane 12 is formed with a central opening 19 through which the mounting means 11 extends. The latter comprises a screw 21 with an internal hexagon head, a stepped washer 22 and a nut 27. The latter also serves as a distance piece relative to the tool housing.

A characteristic feature of the membrane type spring element 12 is that it is completely non-resilient to radially acting forces, i.e. forces acting transversely to the handle at the mounting end of the latter. Transverse forces applied on the handle at a distance from the membrane 12, however, cause elastic bending deformations of the latter. By its somewhat conical shape, the spring membrane 12 is apt not to yield too easily to axial forces, which means that the handle offers a precise control of the tool.

The spring characteristic of the steel membrane 12 and the mass of the inertia element 18 are adapted to the working frequency e.g. the rotation speed, of the tool such that the handle has a resonance frequency that is well below the working frequency of the tool.

Although the above described embodiment of the invention comprises a disc shaped steel membrane having its central part connected to the mounting means and its periphery connected to the handle tube, it is to be noted that the invention also includes the opposite arrangement where the mounting means is connected to the periphery of the steel membrane and the handle tube to the central part thereof.

We claim:

1. Vibration insulated power tool handle, comprising a grip portion (10), a mounting means (11) for rigid mounting on a tool housing, and an elastic vibration insulating member (12) interconnecting said grip portion (10) and said mounting means (11), wherein said vibration insulating member (12) comprises a substantially disc shaped leaf spring element which is connected at its centre to one of said mounting means (11) and said grip portion (10) and at its periphery to the other one of said mounting means (11) and said grip portion (10).

2. Handle according to claim 1, wherein said grip portion (10) is substantially cylindrical, and said spring element (12) is located in a plane substantially transverse to the length axis of said grip portion (10).

3. Handle according to claim 1, wherein said mounting means (11) comprises a screw (21) extending through a central opening (19) in said spring element (12), and said grip portion (10) comprises a bell shaped socket portion (16) formed with an internal circumferential groove (20) for cooperation with the outer periphery of said spring element (12).

4. Handle according to claim 1 wherein said grip portion (10) is tubular and formed in one piece with said socket portion (16).

5. Handle according to claim 1, wherein said grip portion (10) at its free end is provided with an inertia element (18) for lowering the resonance frequency of the handle.

6. Handle according to claim 2, wherein said mounting means (11) comprises a screw (21) extending through a central opening (19) in said spring element (12), and said grip portion (10) comprises a bell shaped socket portion (16) formed with an internal circumferential groove (20) for cooperation with the outer periphery of said spring element (12).

7. Handle according to claim 2, wherein said grip portion (10) is tubular and formed in one piece with said socket portion (16).

8. Handle according to claim 3, wherein said grip portion (10) is tubular and formed in one piece with said socket portion (16).

9. Handle according to claim 6, wherein said grip portion (10) is tubular and formed in one piece with said socket portion (16).

10. Handle according to claim 2, wherein said grip portion (10) at its free end is provided with an inertia element (18) for lowering the resonance frequency of the handle.

11. Handle according to claim 3, wherein said grip portion (10) at its free end is provided with an inertia element (18) for lowering the resonance frequency of the handle.

12. Handle according to claim 4, wherein said grip portion (10) at its free end is provided with an inertia element (18) for lowering the resonance frequency of the handle.

13. Handle according to claim 6, wherein said grip portion (10) at its free end is provided with an inertia element (18) for lowering the resonance frequency of the handle.

14. Handle according to claim 7, wherein said grip portion (10) at its free end is provided with an inertia element (18) for lowering the resonance frequency of the handle.

15. Handle according to claim 8, wherein said grip portion (10) at its free end is provided with an inertia element (18) for lowering the resonance frequency of the handle.

16. Handle according to claim 9, wherein said grip portion (10) at its free end is provided with an inertia element 918) for lowering the resonance frequency of the handle.

* * * * *